US005234045A

United States Patent [19]

Cisko

[11] Patent Number: 5,234,045

[45] Date of Patent: Aug. 10, 1993

[54] METHOD OF SQUEEZE-CASTING A COMPLEX METAL MATRIX COMPOSITE IN A SHELL-MOLD CUSHIONED BY MOLTEN METAL

[75] Inventor: Lawrence W. Cisko, Irwin, Pa.

[73] Assignee: Aluminum Company of America, Pittsburgh, Pa.

[21] Appl. No.: 767,643

[22] Filed: Sep. 30, 1991

[51] Int. Cl.[5] ..... B22D 19/14; B22D 18/00

[52] U.S. Cl. ..... 164/97; 164/113; 164/34

[58] Field of Search ..... 164/34, 35, 98, 97, 164/113

[56] References Cited

U.S. PATENT DOCUMENTS 4,972,898 11/1990 Cole ..... 164/98
5,113,925 5/1992 Cook ..... 164/98

FOREIGN PATENT DOCUMENTS 1104456 4/1989 Japan ..... 164/98
2221176 1/1990 United Kingdom ..... 164/98

*Primary Examiner*—Mark Rosenbaum
*Assistant Examiner*—Rex E. Pelto
*Attorney, Agent, or Firm*—Alfred D. Lobo; David W. Pearce-Smith

[57] ABSTRACT

A squeeze-casting method is taught for manufacturing metal matrix composites which require little or no finishing operations. This method utilizes a combination of techniques, fundamentals of which are found in the investment casting, die casting and metal matrix composite-making arts. The method comprises, forming a wax pattern around the preform and investing the pattern to form a melt-impermeable shell-mold around it. The shell-mold is dewaxed leaving the preform positioned within it. The shell-mold is heated before it is placed in a die cavity of a conventional die caster for high pressure injection of molten metal. Molten metal is poured into the die cavity and pressurized with sufficient pressure and for long enough to impregnate the preform. The metal encapsulates the shell-mold which allows for equilibrated pressures within said die. The pressure is released and the shell-mold is removed from the die cavity before the molten metal in the shell-mold solidifies. When the shell-mold is cooled and the molten metal solidified, the shell-mold is broken and the metal matrix composite removed.

21 Claims, 3 Drawing Sheets

METHOD OF SQUEEZE-CASTING A COMPLEX METAL MATRIX COMPOSITE IN A SHELL-MOLD CUSHIONED BY MOLTEN METAL

BACKGROUND OF THE INVENTION

The production of reinforced metal matrix composites ("MMC") which result in parts with exceptional strength, resistance to wear and to heat, has, to date, only been possible with relatively simple shapes at a cost too high to be practical for any but the most demanding applications. A typical MMC is produced by squeeze-casting a porous ceramic or porous metal core having a higher melting point than the metal part to be reinforced. A porous core in combination with "plugs" for bores, and surface spacers to provide a skin of desired thickness, as will be explained herebelow, is referred to as a "preform" though it may not have a shape which closely conforms to that of the squeeze-cast article to be produced. A metal reticulate of titanium (say) may be impregnated with aluminum, but the invention will be more particularly directed to an open pore ceramic reticulate because ceramic is more commonly used. In a large squeeze-cast article, more than one insert may be used, but more typically, only one is used, and the invention is described using only one integral open pore ceramic insert.

The integral open pore ceramic "preform" is typically placed in a squeeze-casting press; enough molten metal is poured over the preform to impregnate it, and the press is closed. Sufficient pressure is then exerted to impregnate the ceramic preform with the metal.

The preferred "preform" used in my invention is so shaped that, when covered with a metal skin, it corresponds to the shape of the finished, squeeze-cast article. Such an article has a "net" or "near-net" shape requiring very little, if any, machining to meet finished tolerances, and, more preferably, essentially no machining.

The preform may have a shape which does not conform approximately to that of the finished squeeze-cast article. A typical example is that of a squeeze-cast metal part reinforced with a deliberately positioned, bundle of continuous fibers having a higher melting point than the metal, and high tensile strength, positioned so as to provide directional reinforcement where desired; or, a metal part formed by impregnating a shaped mass of metal fibers to provide more general reinforcement. In either case, such a preform is referred to as being a "fibrous insert".

A preform may be a ceramic or metal reticulate in which there is open communication between substantially all pores, but not have approximately the same shape as the desired finished part; or, the preform may be an elongated metal reticulate of arbitrary cross section optionally, additionally, directionally reinforced with an arbitrarily shaped sheet of metal, each having a higher melting point than that of the molten metal used to form the part. In any of the foregoing cases, such a preform is referred to as a "non-fibrous insert".

The production of a metal-impregnated reinforced body, in which a ceramic preform is squeeze-cast to form the MMC, is limited by the present state of the art, to a simple geometric shape, such as a dome or cylinder. It is impractical, from an, economic point of view, to squeeze-cast an object even of such simple shape because it takes so long for the molten metal to solidify, and pressure is maintained during the entire period - unless, of course, if the price of the finished article is inconsequential. In addition, excess metal must typically be removed from the squeeze-cast article. The known process is uneconomic, irrespective of which metal is used, whether essentially unalloyed, or not, and is particularly true for aluminum, magnesium and steel.

The incentive to make MMCs of light metal alloys is particularly great because metals such as aluminum and magnesium have relatively poor resistance to high temperature, to fatigue, and to wear by friction, combined with a relatively low modulus of elasticity compared to steel (say). All of which properties are greatly improved by a molten metal-impregnatable shaped fibrous or non-fibrous insert, preferably a ceramic porous body, shaped so that upon being covered with a metal skin, there results a metal MMC in a "net shape" or "near-net shape". A fibrous insert, for example, one made with reinforcing inorganic, metallic or non-metallic, particularly ceramic, fibers may be appropriately shaped to provide directional reinforcement in a preform. A preform may also be made by combining an integral ceramic preform with fibers.

Of course, the above-identified deficiencies of light metals and their alloys can be negated by randomly distributing short fibers throughout the melt, before casting the part. However, mixing the fibers in the melt before it is squeeze-cast, referred to as being "compocast", produces parts which are far from being comparable in performance to parts squeeze-cast with a fibrous insert. Compocast parts are notably inferior compared with either an insert of an assembly of relatively long fibers more than about 1 cm long, or, a non-fibrous insert of a relatively large single-piece (integral), or, multiple-piece porous ceramic reticulate.

An assembly of fibers may be bundled to provide a shape which is close enough to the desired finished part to provide a near-net shape; or, a bundle of fibers may be overlaid and held in place on a shaped non-fibrous insert having a shape which closely conforms to the desired finished part to yield a "net" or "near-net" shape. Whether an open pore ceramic reticulate, a metal sheet, or a bundle of ceramic or metal fibers, or a combination of two or more thereof, such preforms are preferably so shaped that, upon melt-impregnation and being covered with a metal skin, they are recovered in a "net shape" of the MMC to be manufactured, or a "near-net" shape thereof. But designing a mold to impregnate either a bundle of fibers or a ceramic preform, is a complicated problem. It is a more complicated problem to design a mold to squeeze-cast and thoroughly impregnate a bundle of fibers disposed on a ceramic preform (the combination is sometimes termed a "hybrid preform" but is referred to in the illustrative example provided later herein, simply as a "preform").

A further complication ensues if the MMC is to be squeeze-cast in a ceramic mold rather than a metal mold (because the molten metal is at too high a temperature for an affordable metal mold). A ceramic mold cannot withstand the several thousand pounds per square inch (Ksi) pressure generated during squeeze-casting unless it is perfectly matched to the shape of the metal mold cavity in which it is placed. This mandates squeeze-casting only simple geometric shapes in a ceramic mold perfectly fitted in a metal die.

Even where metal squeeze-casting molds are used, only simple shapes can be formed. For example, in a typical squeeze-casting process for a cone-shaped MMC, the tooling includes a closely tooled punch which is insertable in a downwardly tapered mold (sometimes referred to as a die) lined with a shaped mass of ceramic or steel fibers shaped as a mat conforming to the shape of the cone desired, and to the inner surface of the mold (the walls of the mold cavity). The tooling is lubricated and preheated before the molten charge of metal (say aluminum) is poured into the mold cavity lined with the fibrous mat. While the melt is liquid, the punch is lowered into the mold cavity, tightly closing it, and the punch exerts sufficient pressure to force the melt into the pores of the mat preform. The closed position of the tooling is maintained until the melt solidifies under pressure. Then the squeeze-cast part is ejected, for example by a ram which moves upward against the outside bottom surface of the MMC. This conventional process is more fully described and illustrated herebelow.

It immediately will be evident that sophisticated engineering and close-tolerance tooling is required to squeezecast in the range above about 66.7 Mpa (10 Ksi), even when the part is a simple shape. It will be equally evident that (i) a complex shape cannot be formed in this manner; and, (ii) the time required to cool the tooling for even a part having relatively small dimensions, becomes an onerous economic consideration. Clearly, removing the pressure on the squeeze-cast part in the die was never considered, because there are no provisions for removing the squeeze-cast metal shape while the metal impregnating the preform while the metal is still molten.

There has been no suggestion in the prior art that the time required to squeeze-cast a MMC, then cool it, should be severable, that is, split into two or more time periods.

We have found that in a great number of squeeze-casting operations removing the pressure from the still-molten metal does not adversely affect the strength of the MMC formed, and in such instances, this invention affords an elegant solution to the problems of molding a MMC of complex shape. At the same time, the process of this invention divorces the time required to squeeze-cast metal into the preform, from the time required to cool the metal to solidify it. I have effected such a divorce of essential time periods by combining portions of techniques used in investment casting, in die casting, and in squeeze-casting a MMC.

The logical choice for casting complex shapes is investment casting. As is well known, in investment casting, a wax is injected into a pattern die; the wax pattern is removed from the die; where a relatively small part is to be manufactured, for example, the receiver for a handgun or rifle, several patterns are assembled to wax runners to form a "tree"; the tree is dipped or invested (in a slip of ceramic particles); additional layers, starting with fine sand or other ceramic particles, are applied to the tree in a stucco process; then the stucco shell is dried and dewaxed.

Since the shell is to be used for the mold in which the MMC is to be formed in my process, the mold is referred to as a shell-mold. The shell-mold is hereafter referred to as a "mold" for brevity, and is referred to as a "shell-mold" to distinguish the ceramic shell-mold from a metal "die" (so referred to, instead of referring to it as a "mold", to avoid confusion) in which the shell-mold is to be cradled.

In a conventional investment casting process, the dewaxed mold is preheated; the molten metal is then poured into the hot mold; and the mold is broken away from the casting after it is cooled. The individual parts, which are dimensionally essentially identical to the patterns, are cut from the runners which connect the parts to the ,trunk, of the tree.

It must be remembered that, by definition, in investment casting, no preform, or insert of any kind, is left in the shell-mold. The basic concept of producing a shell-mold is tied to the only reason for doing so, namely, to produce a cavity of the desired shape which the molten metal is to assume. The concept of maintaining a preform within a shell-mold can only derive from the specific intention of using the combination of the preform and shell-mold for a particular purpose, and such a purpose would appear to rule out squeeze-casting as it is presently practiced. Further, using a shell mold in a squeeze-casting process requires that the shell-mold withstand very high hydrostatic pressure. One skilled in the art of casting knows that investment casting is not used in pressure casting situations, and would have no reason to consider using a shell-mold under high pressure conditions.

Still further, the choice of a shell-mold such as is typically used for investment casting, begs to be discarded as soon as it is considered, because, even if one could insert a punch through a passage (through which wax is removed) in the shell-mold, there is no known manner to cushion the outer surface of a frangible ceramic shell-mold in a metal die cavity in such a way that the shell-mold can withstand high pressure exerted by the punch. The slightest non-uniformity of the outer surfaces of either the die or the shell-mold, will cause the shell-mold to crack once the punch exerts much pressure upon molten metal poured into the shell-mold. There appeared to be no practical way to solve the problem. This invention provides a solution to that problem.

SUMMARY OF THE INVENTION

It has been discovered that the time required to squeeze-cast a MMC (metal matrix composite) and cool it, can be split in those instances where it is unnecessary to maintain hydrostatic pressure on a shaped body of an open pore integral ceramic preform, while the molten metal cools; this discovery is equally applicable to a preform of continuous fibers, or a "hybrid" preform of a metal or ceramic reticulate reinforced with fibers, either of which preforms is to be impregnated with molten metal.

It has further been discovered that a MMC having a complex geometry, and of arbitrary size and shape, may be formed by a squeeze-casting process comprising impregnating a preform with molten metal while the preform is held within an invested shell-mold. The shell-mold has a passage through which melt surrounding it enters to impregnate the preform within, but the walls of the shell-mold are essentially impermeable to molten metal under such elevated pressure as is used to squeeze-cast molten metal. The shell-mold is effectively 'suspended' in molten metal within a die cavity so that molten metal surrounding the shell-mold 'cushions' the mold against the inner wall of the die cavity in which the shell-mold is placed. During the time when pressure is exerted against the flowable (or fluent) molten metal between the outer surface of the shell-mold and the inner surfaces of the die cavity, the molten metal cushions the shell-mold against damage by the operating pressures used in the process.

Upon releasing the pressure, soon after the preform is impregnated, and removing the shell-mold from the mold cavity while the metal therein is still molten, the shell-mold is allowed to cool, away from the die cavity, and the MMC recovered by breaking away the shell-mold. The result is a MMC having both overall and directional reinforcement and enhanced physical properties, including higher strength to weight ratio, without sacrificing any desirable physical property of the metal.

It is therefore a general object of this invention to provide a process for making a MMC comprising, providing a reinforcing preform having a porosity (or void fraction) adequate for the purpose at hand, namely impregnation with a molten metal of choice under a chosen elevated hydrostatic pressure of metal, the preform being positioned within a shell-mold;

forming the shell-mold as a hollow body having walls of ceramic particles bound together so as to present inner and outer surfaces of the shell-mold which are essentially impermeable to molten metal;

placing the shell-mold within a pressurizable zone, such as a die cavity provided by a die, within which zone a sufficiently large pressurizing force may be exerted, for example, by piston means reciprocably snugly fitted within the die, to pressurize the zone;

introducing molten metal into the die cavity to fill the shell mold and surround it with molten metal, so as to equilibrate pressure exerted on all surfaces of the shell-mold;

raising the pressure exerted by the piston on the molten metal in the pressurizable zone and within the shell-mold, until the preform is essentially fully impregnated;

returning the pressure in the pressurizable zone to ambient pressure before the molten metal in the shell-mold soldifies;

removing the shell-mold from the die cavity while the metal in the shell mold is still molten;

cooling the shell-mold until the molten metal solidifies; and, recovering the metal matrix composite from the shell mold.

It is a specific object of this invention to provide the foregoing process for making a MMC, comprising, providing a pattern die as is conventional in investment casting; positioning a porous fibrous or non-fibrous preform within the pattern die, the preform being chosen to imbue the finished MMC with desirable physical properties; injecting a removable, solidifiable fluid material such as wax into the pattern, and around and above at least some portion of the preform, preferably encapsulating the entire preform to make a wax pattern; investing the wax pattern of the preform in a slurry of finely divided particles preferably smaller than about 325 U.S. Standard mesh size (less than 44 microns $\mu$, or micrometers m$\mu$) so as to form a shell which is essentially impermeable to molten metal under the pressure used to impregnate the preform; drying and dewaxing the shell mold leaving the preform positioned within it; preheating the shell-mold with the preform positioned therein, and inserting the heated preform into a pressurizable zone wherein melt is pressurized to a pressure sufficiently high to impregnate the preform; removing the shell-mold from the pressurizable zone before the molten metal in the shell-mold solidifies; allowing the shell-mold to cool outside the zone until the melt solidifies; and, recovering the MMC from the shell-mold.

A shaped MMC of specified geometry, formed in a "net" or "near-net" shape, has been discovered which cannot be formed by any method other than the one described herein. Such a shaped MMC formed with at least one melt-impregnatable unit-mold. ary porous ceramic insert, or, formed with relatively long fibers which extend the length of a major portion of the body of the MMC to be formed, or, both, is produced in a net or near-net shape, the body formed having opposed inner surfaces free of a taper sufficient to permit withdrawal of a punch having a corresponding geometry in a squeeze-casting press.

It is therefore another general object of this invention to provide a shaped MMC formed by a process for squeeze-casting a shell-mold containing a preform, in a split-die machine similar to a conventional squeeze-caster for high pressure injection of molten metal, the pressure being in the range from about 66.7 Mpa (10 Ksi) to about 200 Mpa (30 Ksi); removing the shell-mold from the split-die machine before the molten metal in the shell-mold solidifies; allowing the shell-mold to cool until the molten metal solidifies; and, recovering the MMC from the shell-mold.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

Before describing the novel squeeze-casting process in greater detail, it should be recognized that this process is not limited to a MMC of complex shape, though, to help better understand the technical impact of the invention, the process will be described with respect to the squeeze-casting of a specific complex part, namely, the upper portion of a connecting rod. In addition to providing strength, it is known that an appropriately chosen ceramic core will provide a saving in weight in the connecting rod, but to date, I know of no squeeze-casting process which can produce an integral upper portion of a MMC connecting rod. The lower portion or "cap" of the rod, which is generally semicircular, with diametrically opposed, outwardly projecting flanges, is analogously, but far more easily squeeze-cast.

Further, the following detailed description is of a MMC which, in addition to being reinforced with a ceramic preform, is also reinforced with continuous inorganic (stainless steel) fibers. It will be realized that the additional directional strength provided by the steel fibers may not be necessary, but this embodiment is provided herein as a preferred embodiment of the invention, to illustrate how conveniently a shaped bundle of fibers may be positioned on the ceramic preform, and to emphasize that molten metal under sufficient pressure will impregnate and embed both the ceramic and the fibers of the preform.

Figure 1:
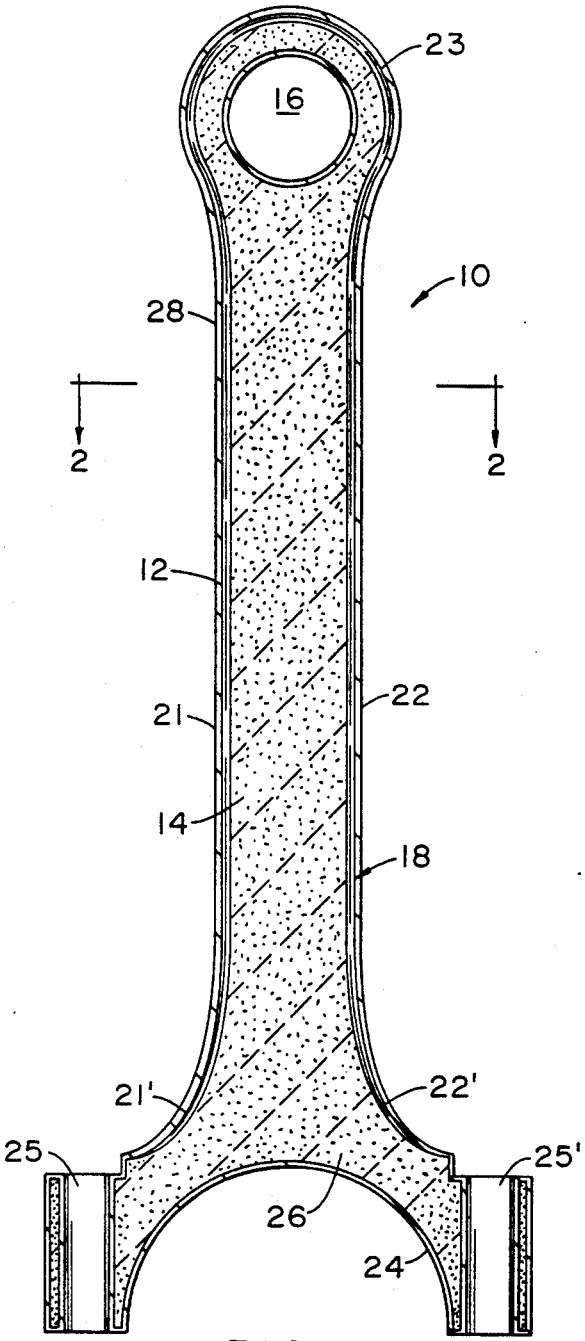
FIG. 1 is a cross-sectional elevational view taken along line I—I in FIG. 2, of a MMC connecting rod for an internal combustion engine, which rod is squeeze-cast using a composite preform. The composite comprises a ceramic core and overlaid continuous, long fibers (a shaped bundle of fibers is shown on the ceramic core; together they are referred to in this embodiment as the "preform") as reinforcement, and the preform is impregnated with molten metal in accordance with the process of this invention.

Such a squeeze-cast, aluminum-impregnated MMC connecting rod, starting with an open pore ceramic core, which is also fiber-reinforced, is schematically illustrated in FIG. 1.

It is known that fiber-reinforced aluminum alloy connecting rods, and those reinforced with an integral open pore ceramic reticulate, exhibit increased buckling strength and increased fatigue strength compared to conventional homogeneous (non-reinforced) connecting rods; and, that the increase in strengths obtained are generally directly proportional to the strength of the ceramic portion of the preform, the number of fibers in the bundle, and the concentration of fibers in portions of the rod where strength is critical. The problem is that penetrating the bundle of fibers with molten metal, particularly in a direction perpendicular to the orientation of the fibers, becomes increasingly difficult as the number of fibers in the bundle increases. The increase in the number of fibers not only increases the pressure drop into the core of the bundle, but requires that the bundle be adequately preheated to avoid chilling molten metal contacting the surface of the bundle.

It will be evident that in areas where fibers overlie the ceramic core, as illustrated in the preferred embodiment, the difficulty of impregnating the core is exacerbated. The following description of the MMC connecting rod, and how it is made, describes how the problems relating to the successful formation of a near-net shape of a MMC are obviated; and at the same time, how problems relating to reinforcement of the MMC with relatively long inorganic fibers, preferably fibers which are continuous over the portion of the MMC to be reinforced, are minimized.

Referring to FIG. 1 there is shown a cross-sectional view of a fiber-reinforced MMC connecting rod indicated generally by reference numeral 10, which rod is reinforced with an integral ceramic open pore reticulate 14 having substantially the same shape as the MMC to be formed. A bundle of fibers 12 is draped on the outer surface of the ceramic core. The fibers may be of metal, such as stainless steel, or fibers of boron, or carbon, or a yarn or whisker fiber assembly of ceramic fibers such as silicon carbide, all of which are known in the art to provide metal reinforcement, and some of which are commercially available. Each of the fibers is preferably continuous over one side of the upper portion of the connecting rod and down the other side so as to additionally, directionally reinforce the connecting rod.

The fibers are bundled unidirectionally by a suitable technique and tied or otherwise positioned on either side of, and around the eye 16 (bore for wrist-pin in the "narrow end" of the connecting rod) of the connecting rod to form (hybrid) preform 18. The fibers 12, appropriately tied in a shape of desired cross section, and tied to the outer surfaces of the ceramic core 14, are thus provided with the desired bends and contours. Removable cores (not shown) are used to provide the eye 16 and through-bores 25 and 25'. It is now seen how a preform 18 of arbitrary shape may be constructed with a porous ceramic core 14 and overlaid bundle of fibers 12.

As shown, stainless steel fibers 12 having a diameter of about 25$\mu$ are loosely tied, or otherwise assembled, as a relatively flat bundle upon opposed sides of the core 14 so that the entire preform can be quickly and effectively impregnated with molten metal. The bundle may also be elliptical or circular in cross-section, but as will be evident, the former shape will be easier to impregnate thoroughly than the latter, all other conditions being the same.

Other methods for producing a hybrid preform may be used, such as weaving, knitting and winding fibers around the ceramic core. Instead of using a shaped composite of ceramic and fibers, the preform 18 may be made entirely of fibers 12, forming a near-net-shaped fiber body. Such a body may be formed by weaving, knitting and winding. The preform may be entirely of a net- or near-net shaped porous ceramic core 14 without fiber reinforcing. The essential criterion for the preform, whether ceramic or metal reticulate, or, ceramic or metal fibers, or any combination thereof, is that its pores or void space be penetratable by molten metal at the hydrostatic pressure to be used in the squeeze-casting process. A typical pressure is in the range from 500–2000 kg/cm$^2$.

The fibers 12 around the core 14 conform to its outer surface forming parallel legs 21 and 22 which extend downward after being looped around circumferential outer portion 23 of the eye 16 of the core, and flare outwardly over either side of wide portion 26 of the ceramic core 14, so that the lower portions 21' and 22' of the legs, together with the lower portion of the ceramic core 14, provide reinforcement for the base of the connecting rod.

The base of the MMC connecting rod 10 is provided with a semi-circular bearing seat 24 and the through bores 25 and 25' on either sides thereof for the purpose of securing the "cap" (lower portion) of the connecting rod (not shown). The cap of the connecting rod may be analogously formed by squeeze-casting aluminum around a preform of an open pore ceramic reticulate of essentially the same shape and dimensions as the cap, overlaid with a fiber bundle, if desired.

The connecting rod 10 is most preferably formed by squeeze-casting molten aluminum into and around the preform 18, to leave a "skin" 28 on the preform (thickness of melt covering the preform) by the method described herebelow.

The initial portion of the process requires placing the preform in a pattern die of the connecting rod 10 to be squeeze-cast, and conventionally injecting wax into the pattern die. The dimensions of the pattern die are chosen to provide a desired thickness or "skin" 28 of metal around the preform. Typically the thickness of such a skin ranges from 0.5 mm - 5 mm to ensure a smooth outer surface on the connecting rod, but it is not necessary to provide a skin 28 over the entire preform to obtain strength from the reinforcement.

A wax pattern is formed of the ceramic preform 18 using surface spacers 33 (see FIGS. 3 and 4) of appropriate thickness. Not all spacers are illustrated, for example, spacers 33 in the eye 16, and the bores 25 and 25' of the preform are not visible; neither are the plugs which provide the eye 16 and the bores 25 and 25'.

The wax pattern is removed from the pattern die and dipped ("invested") in a slurry of fine ceramic particles which are preferably smaller than 44μ in average diameter, more preferably less than 20μ, so as to form, when the slurry is dried and the particles bound together, a shell-mold 30 having a melt-impenetrable interior wall 31 This step may be repeated as often as is required to form the barrier which may be from about 1 mm to about 5 mm thick.

The invested pattern is then dipped in a slurry of sand particles larger than 44μ and dried in a "stucco process" to build up the shell-mold 30 around the wax pattern. This stucco process is repeated as often as is necessary to build up a finished shell-mold with a coarse surface, but having sufficient strength to withstand the pressure to be used in the squeeze-casting process, typically a wall thickness in the range from about 5 mm to 10 mm thick.

The coarse surface of the finished shell-mold is preferably given a "seal coat" of fine ceramic particles to provide a thin exterior barrier 32 from about 1 mm - 5 mm thick, against infiltration of melt under high pressure. The walls of the shell-mold are thus sealed, both from within and from the outside, against molten metal, with continuous interior and exterior fluid-tight coatings of bonded, fine ceramic particles.

To maintain the precise position of the preform in the shell-mold, particularly if the skin 28 is desired to be substantially uniform, uniform surface spacers 33 (visible in FIGS. 3 and 4) are made of a suitable melt-compatible material, preferably the same metal or alloy as the melt, which will melt only after the melt surrounds the preform. Such spacers may be adhesively secured to the surface of the ceramic preform 18 with a high-melting adhesive, higher melting than the wax used, and remain secured to the insert while the preform 18 is being covered with molten wax.

The shell-mold 30 is then dewaxed by melting the wax out of the shell-mold, leaving a passage 34 in the wall of the shell-mold, and leaving the preform 18 within the shell-mold.

Figure 3:
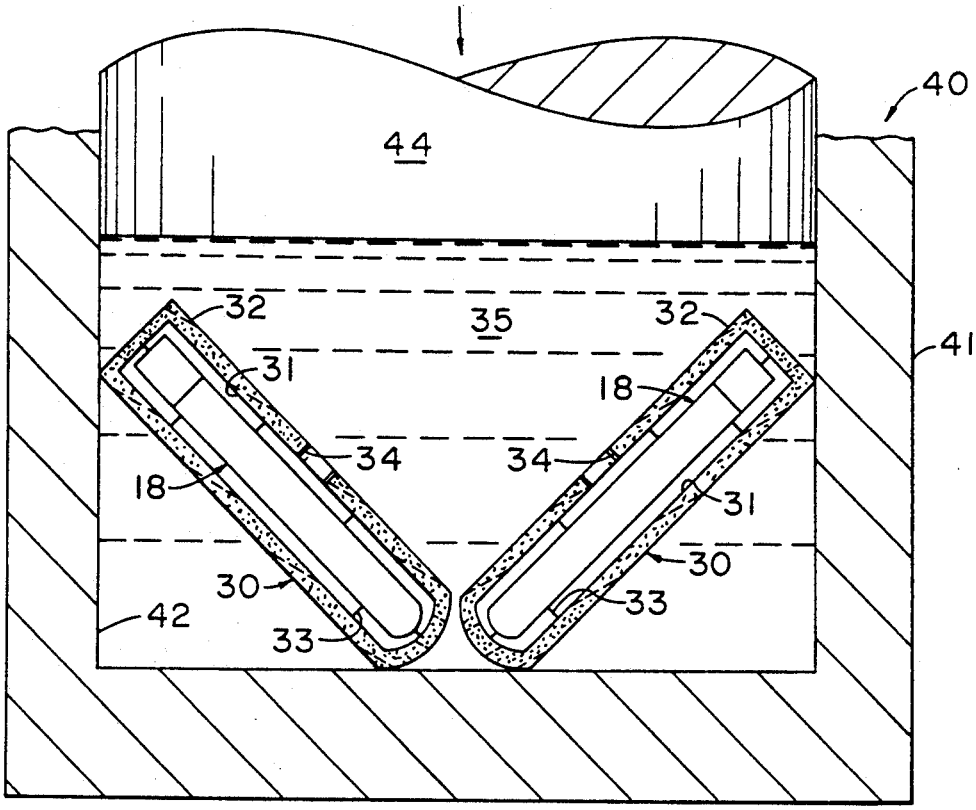
FIG. 3 is a schematic illustration of two shell-molds each containing a preform, shown leaning up against the sides of a large die, illustrating the point that the position of the shell-mold is of little significance as long as a passageway in the shell-mold allows melt to infiltrate all portions of the preform; melt commences to infiltrate the preform essentially instantaneously; when the preform includes a bundle of fibers, infiltration occurs mainly from a direction perpendicular to the orientation of the fibers.

In the squeeze-casting step of the process, the shell-mold 30 is placed in a die 41 of a squeeze-casting press 40 (only a portion of which is schematically illustrated), so that molten metal 35 poured into die cavity 42 will surround the shell-mold 30. As shown in FIG. 3, plural shell-molds 30 may be placed in the die cavity 42, if the cavity is large enough. The shell-molds 30 are illustrated as being placed in an arbitrary position in the bottom of die cavity 42, and molten metal (aluminum) 35 is poured into the mold to fill the shell-molds and cover them with enough metal so that piston 44 of the press will not bear directly against the shell-molds. The spacers 33 will determine the approximate thickness of a skin 28 of metal formed after the MMC is cured. As illustrated in FIG. 3, the die cavity is simply a cylinder in which a close-fitting piston 44 exerts the required pressure.

As will now be evident, the melt 35 within the shell-molds 30 transmits hydrostatic pressure to the same extent as does the melt 35 in the die cavity 42. Thus, the hydrostatic pressure inside the shell-mold 30 and outside (in the die cavity 42) is substantially identical. The walls of the shell-mold are therefore not subjected to uneven stresses, but are cushioned between two fluid masses, each under essentially the same very high pressure during operation of the squeeze-casting press.

As soon as the preform 18 is thoroughly impregnated, the piston 44 is withdrawn from the die cavity 42, and the shell-molds 30 lifted out of the molten metal within the die cavity. The metal within the shell-molds is still molten when the shell-molds are removed from the pool of melt in the die cavity. The shell-molds are allowed to cool outside the die cavity. While the metal in the die cavity is still molten, other preheated shell-molds, each containing a preform, are inserted into the pool of melt within the die cavity and the piston lowered into the die cavity to squeeze-cast molten metal into the preforms within the shell-molds. Thus it is seen that plural preforms in shell-molds may be simultaneously squeeze-cast without damaging the walls of the shell-molds.

If desired, the geometry of the shell-mold may be "normalized" by building up the walls of the shell-mold, or packing the shell mold in a heat-resistant jacket of predetermined geometry, preferably a cylinder of refractory material or a high-melting inorganic salt, to minimize the excess molten metal left over after the preform is impregnated, and to facilitate the insertion and removal of the squeeze-cast part. The shell-mold is normalized by building up its melt-impenetrable walls to present a periphery which conforms to the cross section of the die cavity, the dimensions of which are such as to slidably receive the normalized shell-mold.

Figure 4:
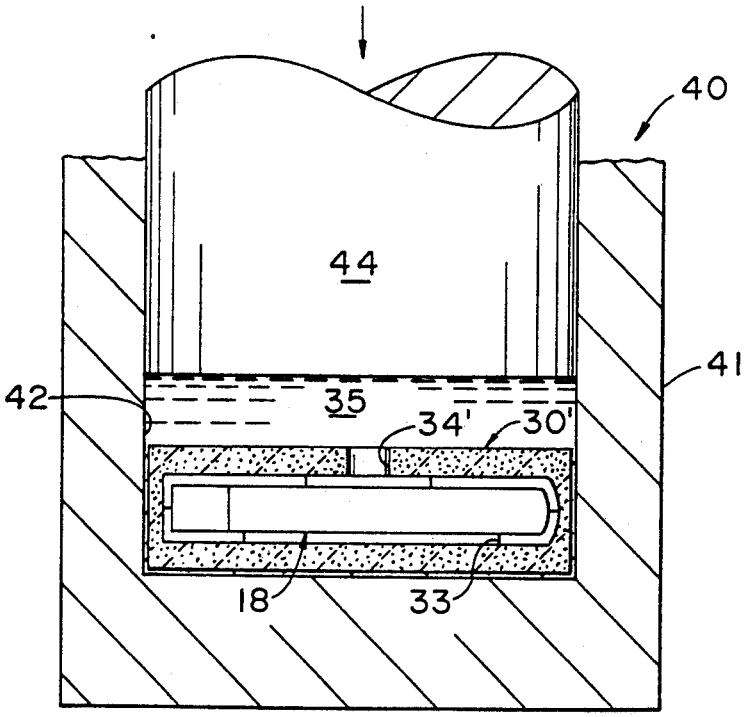
FIG. 4 is a schematic illustration of a "normalized" shell-mold containing the preform in a lateral position in a normalized shell-mold which rests directly on the bottom of the die cavity; the normalized shell-mold is slidably disposed in the die so that upon impregnation of the preform in the shell-mold, the amount of melt left in the die cavity outside the shell-mold is minimized.

As indicated in FIG. 4, a normalized shell-mold 30' having a melt passage 34' is slidably inserted in the die cavity 42 so that the shell-mold 50 rests on the bottom of die cavity 42. Molten aluminum 35 is poured into the die cavity and the melt is pressurized as described hereinabove. It will be appreciated that, even in a die cavity which closely fits around the normalized shell-mold, the unevenness of the surface of the shell-mold due to projections of individual sand particles, is not entirely smoothed out in the final "finishing coat" of fine and/or superfine ceramic particles. Even a very slight unevenness due to projections of 20μ, permits melt to flow around the shell-mold completely surrounding it and cushioning it against the wall of the die cavity to avoid damage from hydrostatic pressure.

The pressure which can be generated in the squeeze-casting press will determine the porosity of the preform which can be impregnated within a practical amount of time, the lower the porosity, the higher the pressure required. A preferred time for the squeeze-casting step in the press will depend in part upon the size of the preform to be impregnated and the concentration of fibers, or the porosity of the open pore ceramic reticulate. A preform desirably has a void fraction >0.01. A preferred void fraction is in the range from about 0.1 to about 0.7; from 0.01 to 0.2 for fibers, and 0.1 to 0.5 for reticulate. Such void fractions provide excellent reinforcement with a squeeze-casting time in the press in the range from about 30 secs to about 2 minutes.

The type of squeeze-casting press used is not narrowly critical so long as it provides a "window" through which the tooling can be inserted, and the punch is forced into the die cavity under hydraulic pressure so that the ram (and punch) exerts essentially constant pressure within the die cavity. Commercially available hydraulic presses such as those made by Miller Fluid Power Corp, Bensonville, Ill. may be modified to serve the purpose at hand.

Figure 2:
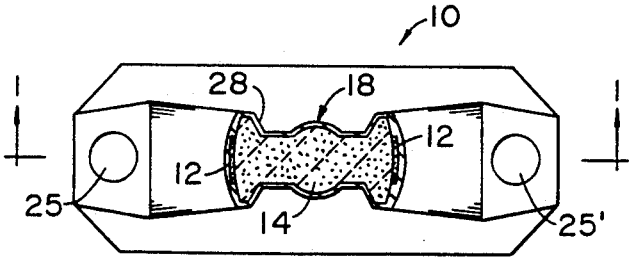
FIG. 2 is a cross-sectional end view taken along the line II—II in FIG. 1.

Upon cooling the shell-mold, the MMC connecting rod illustrated in FIGS. 1 and 2 is recovered by breaking away the shell-mold. If this task proves unduly arduous because a substantial amount of metal is left on the outer surface of the cooled shell-mold the cooled shell-mold may be placed in a "clean-up furnace" where it is exposed briefly to a temperature higher than the melting point of the metal coating the shell-mold, causing the metal to melt away from the shell-mold. The thickness of the wall of the shell-mold provides sufficient insulation against the heat of the furnace to avoid damaging the near net shape of the squeeze-cast connecting rod formed.

As illustrated in FIG. 2 the central portion of the ceramic core 14 and the opposed portions of the relatively flat bundle of fibers 12 are thoroughly impregnated with metal, and the elongated portion of the rod is provided with a smooth skin 18 which sheds oil quickly. The fiber bundle 12 provides additional reinforcement where it is most needed.

In a specific example a shaped ceramic core preform for the connecting rod may be produced from a commercially available silicon carbide/alumina material (from Carborundum or Norton). A boron carbide/boron nitride ceramic may also be used. The ceramic, having a void fraction of about 0.3, is overlaid as described above, with a generally flat bundle of fibers which are drawn from a material preferably having a coefficient of thermal expansion which is matched to that of the ceramic core. Preferably about 10,000 continuous fibers of 304, 316, 321 or 347 chrome-nickel stainless steel, each fiber about 50 microns in diameter can provide a bundle, about 4 mm thick, 5 mm wide, and about 150 mm long. This bundle is tied to the ceramic core 14 with a strand of some more of the same fibers, to position the center line of the bundle in the central vertical plane of the connecting rod. The bulk density of the bundle is about 3.7 gm/cc.

It is unnecessary to weld the fibers to each other to maintain the shape of the bundle. If desired, the fibers may be bundled by adhesively securing them to each other in a mold dimensioned to correspond to the dimensions of the ceramic core. The shape of the core can equally accommodate a different predetermined cross-section of the bundle, for example, elliptical or generally circular. Alternatively, the fibers may be held in a pre-shaped sheath of polyethylene film and tied to the ceramic insert. The adhesive or polyethylene is carbonized when molten metal is poured into the shell-mold, the sheath being a fugitive sheath which releases the fibers and allows melt to penetrate the bundle.

The choice of type of ceramic insert used, its shape, porosity (or void fraction) and other physical characteristics are well within the skill of one engaged in this art, as is the choice of fibers used, their number, optimum dimensions, and other physical characteristics. Depending upon the application, for example in the manufacture of receivers for guns, only the ceramic insert may be impregnated. For gun barrels, however, particularly those of relatively large bore heavy artillery, the ceramic insert may be overlaid with wound fibers in a pattern of choice, as is conventionally done in the manufacture of fiber reinforced pressure vessels of synthetic resinous materials.

As will now be evident, this invention has particular application in the squeeze-casting of relatively large articles such as large gun barrels having a bore in excess of 20 mm because an integral cylindrical ceramic barrel insert of arbitrary length and controlled porosity is within the skill of the art. Because the molten metal permeates the pores of the ceramic insert as well as the interstices between fibers, the compressive stresses which occur even when a relatively thick skin 28 of the cast metal solidifies around the preform, are insufficient to cause crack initiation or catastrophic failure of the ceramic core 14. This permits considerable latitude in the choice of matching thermal expansion coefficients of the ceramic and metal.

The ceramic barrel core may then be used as a mandrel upon which is woven at least one, and preferably plural layers of mesh of high tensile, high melting steel wire to form the preform. The preform is then invested, stuccoed to normalize the shell-mold, dewaxed and fired in a furnace to preheat the preform to a desired temperature about the same as, or only from 20° C. – 50° C. lower than the temperature of molten steel to be used in the squeeze-casting step. The preheated normalized shell-mold with the preform positioned therein, is then slidably inserted in a long cylindrical die with a removable end closure, and molten metal is poured into the die cavity. A piston pressurizes the molten steel to penetrate the interstices between the fibers, which are unaffected at the temperature of the molten steel, and also to penetrate the pores of the ceramic insert. Immediately thereafter, before the molten metal solidifies, the end closure on the die is removed and the impregnated preform ejected from the die cavity. Excess molten metal drips off the surfaces of the shell-mold before it cools sufficiently to solidify metal left on its surface. When cooled to ambient temperature, the shell mold is broken away.

While the die cavity is still at a temperature above the liquidus temperature of the steel, another preheated preform is inserted into the die, and the foregoing manufacturing cycle is repeated.

The solution to the problem of forming a MMC gun barrel in a near-net shape, and that of forming the aforedescribed connecting rod or other complex shape by my process will be better appreciated in view of a more detailed consideration of a conventional squeeze-casting process. The following is a description of how a tapered cylindrical MMC having a tapered through-bore is formed, because a cylindrical MMC with a central longitudinal through-bore cannot be formed by a conventional process. The punch cannot be withdrawn in a conventional squeeze-casting process unless the bore is tapered, and the MMC cannot be ejected from the die unless its exterior walls are tapered.

Figure 5:
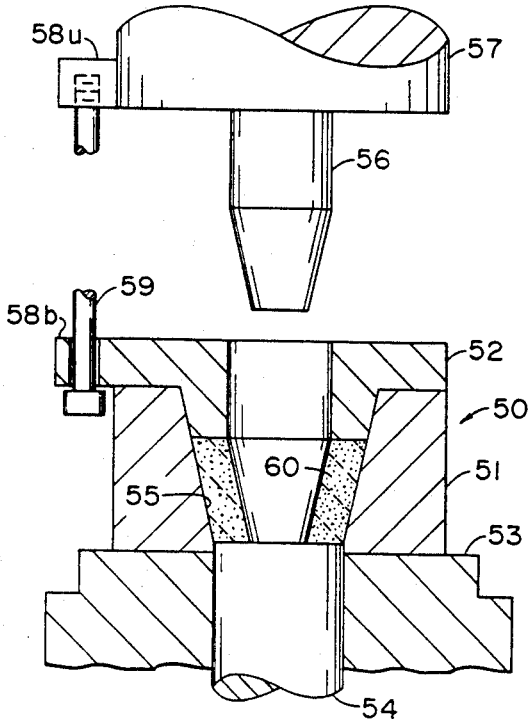
FIG. 5 is a schematic illustration, partially in cross section and with portions broken away, of a conventional, open, squeeze-casting press, prior to forming a MMC of a tapered cylindrical ceramic preform, showing the preform in a die, and a closely tooled punch having a tapered-profile corresponding to the geometry of the tapered cylindrical inner bore of the ceramic preform.

Referring to FIG. 5 there is shown a die indicated generally by reference numeral 50 having a lower portion 51 and an upper portion 52, the former being mounted on a base 53 as in a conventional squeeze-casting press. The base houses a closely fitted ejection piston 54 which can travel upwards through a nearly cylindrical, slightly tapered die cavity 55 in the lower portion 51 of the die to eject a part formed therein.

The die cavity 55 is necessarily tapered, the diameter near the top being slightly greater than that of the bottom, as shown greatly exaggerated in the drawing. A tapered ceramic cylinder 60 having an axial tapered bore, the diameter of which is greater near the top than at the bottom, is inserted into the lower portion of the die. The outer surface of the ceramic tapered cylinder 60 closely matches the inner surface of the die to minimize damage to the ceramic insert when pressure is exerted by a punch 56. All surfaces of the die and punch which are to come into contact with molten metal are adequately lubricated as is conventionally done in the art.

The punch 56 is centered in a ram 57 provided with opposed upper side-tabs or "upper ears" 58*u* and 58*u*' having threaded bores (only one of the ears is shown) in each of which a guide-and-lift rod 59 and 59' respectively, is threadedly secured so that it hangs vertically downwards. One end of each guide-and-lift rod is threaded, and the other is enlarged. The upper portion 52 of the die is also provided with opposed lower ears 58*b* and 58*b*' having through-bores therein (only one ear is shown) directly aligned beneath upper ears 58*u* and 58*u*' respectively, so that the guide-and-lift rods 59 and 59' may be slidably inserted through the bores in lower ears 58*b* and 58*b*'. The enlarged ends of the guide-and-lift rods 59 and 59' are larger than the diameter of through-bores in the lower ears 58*b* and 58*b*' to enable the rods to lift the upper portion 52 of the die.

As shown in FIG. 5, soon after a measured amount of molten metal is poured into the die cavity, the guide-and-lift rods 59 and 59' help guide the upper portion 52 into the die cavity 55 so that it comes to rest on the ceramic insert 60 axially vertically aligned with the punch 56.

Figure 6:
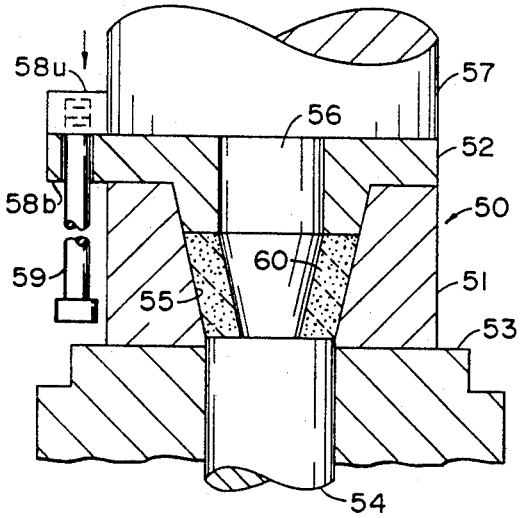
FIG. 6 illustrates the closed press after molten metal is poured into the die cavity, with the closely tooled punch lowered into the die to form the MMC (tapered cylinder).

Referring to FIG. 6 it is seen that the punch 56 has been lowered into the die to pressurize the molten metal in the die cavity with a substantially constant force sufficiently to suffuse melt throughout the ceramic insert. The punch is held in position until the insert, impregnated with molten metal, has cooled at least sufficiently to solidify the metal, and then the punch is retracted. The guide-and-lift rods, having accomplished the task of centering the punch in the die cavity, continue to move through bores in the lower ears 58*b* and 58*b*', downwards with the ram 57.

Figure 7:
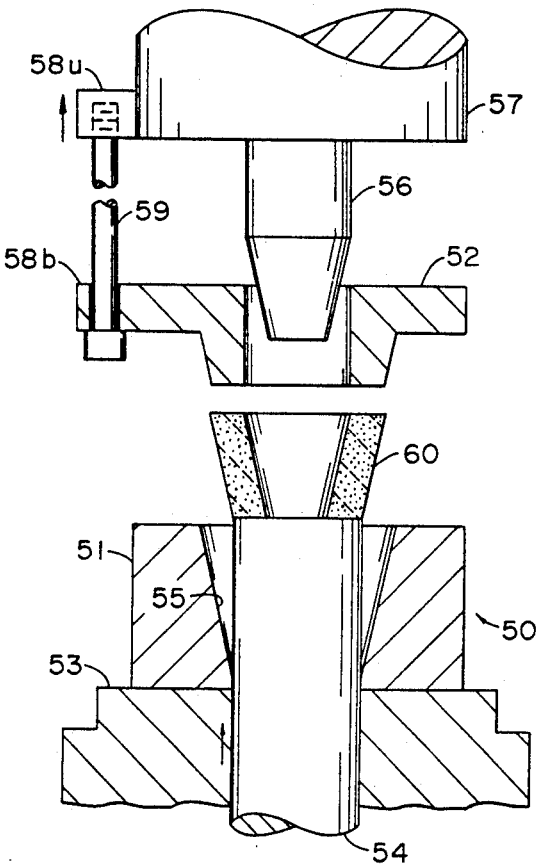
FIG. 7 illustrates ejection of the squeeze-cast MMC from the die after the melt has solidified.

In FIG. 7 the ram 57 with the punch 56 is retracted causing the enlarged ends of the guide-and-lift rods to become lodged against the bottom surfaces of the lower ears 59*b* and 59*b*', and to lift the upper portion 52 of the die high enough to provide a "window" (the distance between the lower surface of the upper portion 52 and the upper surface of the lower portion 51) through which the cooled MMC to be removed after it is ejected by the piston 54.

It will now be evident that the MMC could not be removed from the die cavity without a tapered outer cylindrical surface; and it could not be removed from the punch without a tapered axial bore. Moreover, the amount of molten metal to be trapped in the die cavity must be closely metered. Assuming the amount of molten metal is precisely metered into the die cavity for the dimensions of the dimensions of the tapered MMC cylinder to be squeeze-cast, with the specific intention of machining away the excess metal, note that the "skin" of metal left on the machined cylindrical axial bore will vary from bottom to top. If the outer surface of the insert 60 is closely matched to the inner surface of the die cavity 42; and, the inner surface of the insert 60 is closely matched to the surface of the punch, and the precise amount of melt is poured into the die cavity to avoid machining away excess metal, the skin on the squeeze-cast product will be very thin. If the surfaces are not closely matched and the amount of melt poured into the die cavity is in excess of what is required, then, upon solidification, the excess metal must be machined away. In a long gun barrel, a difference in thickness of skin is not acceptable because it greatly affects the heat transfer and expansion characteristics of the gun barrel. Therefore, a squeeze-cast gun barrel is routinely machined after it is squeeze-cast.

Further, though wax has been identified as the preferred solid fluidizable material to form a pattern with the fluidizable solid material, it will be appreciated that other synthetic resinous materials may be substituted for wax. For example, now conventionally used in certain instances are foamed-in-place polyurethane or polystyrene, either of which is incinerated when the pattern with fluidizable material is heated to yield the desired shell-mold with internal preform.

It is now evident that no MMC article of specified geometry containing a preform of relatively long fibers which extend the length of a major portion of the MMC's body, or, formed with at least one melt-impregnatable unitary porous ceramic insert, can be formed by any method other than the one described herein. The shaped MMC of my invention is formed in a near-net shape having opposed inner surfaces free of a taper sufficient to permit withdrawal of a punch having a corresponding geometry in a squeeze-casting press. As a result the shaped MMC of my invention need not be machined, or, if machined, will leave a metal "skin" of uniform thickness over the preform, or of predetermined thickness where a uniform thickness is not desired.

Having thus provided a general discussion, described the overall process in detail, and illustrated the invention with specific examples of the best mode of carrying out the process, it will be evident that the invention has provided an effective yet simple solution to a difficult problem. It is therefore to be understood that no undue restrictions are to be imposed by reason of the specific embodiments illustrated and discussed herein, except as provided by the following claims.

I claim:

1. A process for making a metal matrix composite comprising, providing a melt-impregnatable, reinforcing preform having a void fraction adequate to be impregnated with a molten metal under a chosen elevated substantially constant hydrostatic pressure, said preform being positioned within a shell-mold having a passage for introduction of said molten metal;

forming said shell-mold with a wall of ceramic particles bound together so as to present interior and exterior surfaces of said shell-mold which are essentially meltimpenetrable barriers under said elevated pressure;

placing said shell-mold within a pressurizable zone; introducing molten metal into said pressurizable zone, to fill said shell-mold and surround it with said molten metal to equilibrate pressure exerted on all surfaces of said shell-mold;

maintaining said substantially constant hydrostatic pressure within said pressurizable zone until said preform is essentially fully impregnated;

returning said pressurizable zone to ambient pressure before said molten metal in said shell-mold solidifies;

removing said shell-mold from said pressurizable zone prior to solidification of said molten metal within said shell-mold;

cooling said shell-mold to solidify said molten metal; and, recovering said metal matrix composite from said shell mold.

2. The process of claim 1 wherein said preform is an integral porous reticulate of arbitrary size and near-net shape having a void fraction in the range from 0.1 to 0.7, and said pressure at which said preform is impregnated is in the range from about 500–2000 kg/cm$^2$.

3. The process of claim 1 wherein said preform is a mass of continuous inorganic fibers positioned within said shell mold as a shaped body of near-net shape having a void fraction in the range from 0.01 to 0.2, and said pressure at which said preform is impregnated is in the range from about 500–2000 kg/cm$^2$, and said metal matrix composite has a near-net shape covered with a metal skin.

4. The process of claim 2 wherein said reticulate is a ceramic.

5. The process of claim 1 wherein said preform comprises an integral porous reticulate overlaid with a mass of continuous inorganic fibers, and said preform is positioned within said shell mold as a shaped body of near-net shape having a void fraction in the range from 0.01 to 0.7, and said pressure at which said preform is impregnated is in the range from about 500–2000 kg/cm$^2$.

6. The process of claim 5 wherein said fibers are selected from the group consisting of metal, silicon, carbon and boron fibers.

7. The process of claim 6 wherein said fibers are held in a fugitive sheath.

8. In a process for making a metal matrix composite ("MMC") without regard for the time required to cool impregnated molten metal within and surrounding said composite, the improvement comprising, (a) providing a pattern die corresponding to the net shape of said metal matrix composite;

(b) positioning a porous inorganic preform within said pattern die;

(c) injecting a removable, solidifiable fluid material into said pattern die, and around and above at least some portion of the preform to form a pattern with said fluidizable material;

(d) investing said pattern with fluidizable material in a slurry of particles to form a shell-mold which is essentially impermeable to molten metal under pressure used to impregnate said preform;

(e) drying said shell-mold and removing said fluidizable material from said dried shell-mold leaving said preform positioned within said shell-mold;

(f) preheating said shell-mold with said preform positioned therein to provide a heated preform;

(g) pressurizing molten metal at sufficiently high pressure within and surrounding said shell-mold, to impregnate said preform and equilibrate pressure exerted on all surfaces of said shell mold;

(h) removing said shell-mold from said pressurizing zone before said molten metal in said shell-mold solidifies;

(i) cooling said shell-mold away from said pressurizing zone; and, (j) recovering said metal matrix composite from said shell-mold.

9. The process of claim 8 wherein said particles are smaller than about 325 U.S. Standard mesh size (less than 44$\mu$, microns), and said pressure is in the range from about 66.7 Mpa (10 Ksi) to about 200 Mpa (30 Ksi).

10. The process of claim 8 wherein said preform is an open pore reticulate.

11. The process of claim 10 wherein said reticulate is a ceramic.

12. The process of claim 10 wherein said fluidizable material is wax.

13. The process of claim 8 wherein said preform comprises an integral porous reticulate overlaid with a mass of continuous inorganic fibers, and said preform is positioned within said shell mold as a shaped body of near-net shape having a void fraction in the range from 0.01 to 0.7, and said pressure at which said preform is impregnated is in the range from about 500–2000 kg/cm$^2$.

14. The process of claim 13 wherein fibers in said mass of fibers are produced from a fiber-forming metal or a fiber-forming ceramic.

15. A method for forming a metal matrix composite, comprising, removably disposing a substantially melt-impermeable shell-mold within a pressurizable zone, said shell-mold having a melt-impregnatable reinforcing preform positioned therewithin;

introducing molten metal into said pressurizable zone, to fill said shell-mold and encapsulate it within said molten metal so as to cushion said shell-mold in said zone with said molten metal which equilibrates pressure to be exerted on all surfaces of said shell-mold;

increasing said pressure within said pressurizable zone until said preform is essentially fully impregnated;

returning said pressurizable zone to ambient pressure before said molten metal in said shell-mold solidifies;

removing said shell-mold from said pressurizable zone prior to solidification of said molten metal within said shell-mold and cooling it to solidify said molten metal; and, recovering a metal matrix composite from said shell mold; whereby the time to impregnate said preform is divorced from the time required to solidify said molten metal in and around said preform.

16. The process of claim 15 wherein said particles are smaller than about 325 U.S. Standard mesh size (less than 44$\mu$, microns), and said pressure is in the range from about 66.7 Mpa (10 Ksi) to about 200 Mpa (30 Ksi).

17. The process of claim 15 wherein said preform is an open pore reticulate.

18. The process of claim 17 wherein said reticulate is a ceramic.

19. The process of claim 17 wherein said fluidizable material is wax.

20. The process of claim 15 wherein said preform comprises an integral porous reticulate overlaid with a mass of continuous inorganic fibers, and said preform is positioned within said shell mold as a shaped body of near-net shape having a void fraction in the range from 0.01 to 0.7, and said pressure at which said preform is impregnated is in the range from about 500–2000 $kg/cm^2$.

21. The process of claim 20 wherein fibers in said mass of fibers are produced from a fiber-forming metal or a fiber-forming ceramic.

* * * * *